United States Patent [19]

Meiller et al.

[11] 4,206,533

[45] Jun. 10, 1980

[54] PUSH BUTTON LOCK FOR SAFETY BELT

[75] Inventors: Hermann Meiller, Amberg; Horst Hocke, Mimbach, both of Fed. Rep. of Germany

[73] Assignee: Messrs. Willibald Grammer, Fed. Rep. of Germany

[21] Appl. No.: 900,106

[22] Filed: Apr. 26, 1978

[30] Foreign Application Priority Data

Apr. 30, 1977 [DE] Fed. Rep. of Germany ... 7713685[u]

[51] Int. Cl.[2] ..... A44B 11/25

[52] U.S. Cl. ..... 24/230 AK; 24/230 A

[58] Field of Search ..... 24/230 A, 230 AK, 230 R, 24/230 AL, 230 TC, 230 BC, 230 AS, 230 AT

[56] References Cited

U.S. PATENT DOCUMENTS

| | | | |
|---|---|---|---|
| 3,883,932 | 5/1975 | Meiller et al. | 24/230 A |
| 4,004,115 | 1/1977 | Esner | 24/230 A |
| 4,094,046 | 6/1978 | Takada | 24/230 AK |
| 4,136,425 | 1/1979 | Esner | 24/230 A |

*Primary Examiner*—Alexander Grosz

[57] ABSTRACT

A push button lock for a safety belt is described including a first lock part which has an insertion aperture at one end, and a second slide in tongue part which is insertable into the opening in an axially extending plane of the first part. Within the first part there is a receiving housing which includes a web portion with a side wall on each side edge of the web portion which latter has a fixed stop which is engageable on a transverse edge formed on the tongue.

A slot is provided in each side wall of the receiving housing and this has a first part which is parallel to the axial plane and a second part inclined with respect thereto. The housing has a push button which is axially slideable therein and this comprises a cross-bar, two side walls which are spaced apart by the cross-bar and a manually actuable portion at the insertion opening end of the lock part. When one presses the manually actuable portion, two elements, which can be part of the cross-bar, slide in these slots to lift the push button so that the cross-bar is raised to release the tongue portion so that the transverse edge can be disengaged from the stop.

9 Claims, 2 Drawing Figures

PUSH BUTTON LOCK FOR SAFETY BELT

Figure 1:
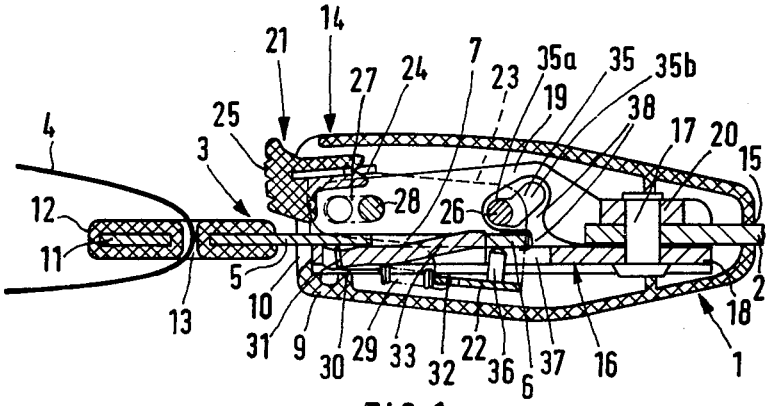

The present invention relates to pushbutton locks for safety belts.

Many different forms of pushbutton locks for safety belts have been proposed in the past. One particular type, which is closest to the subject of the invention is disclosed in German Pat. No. 2,339,910 and comprises on the one hand a lock part fastened to one belt end and on the other hand a slide-in tongue part which can be fixed therein, and to which the other belt end is fastened. The lock part has, in the outer casing on the front, a window opening in which a pushbutton for releasing the locking of the lock part is located. The pushbutton is arranged parallel to the insertion opening of the lock part or to the slide-in tongue which has been introduced, and can be actuated by pressure in the direction transverse to the latter. Experience has shown that this arrangement of the pushbutton has disadvantages. The pushbutton lock is usually fitted on safety belts in such a way that the lock part is fixed so as to be immobile on the side of the seat close to the floor and stands vertically so that the insertion opening made in the front face of the lock part points upwards. As a result, the insertion opening is readily visible and the slide-in tongue part can easily be introduced into the insertion opening. The laterally arranged pushbutton is either not at all visible from the seat, or is only poorly visible. The window opening in the outer housing of the lock part must thus be found mainly by feeling before the pushbutton can be actuated to release the belt lock. If it were desired to find the pushbutton visually, it would be necessary to bend laterally over the lock part fastened to the side of the seat, but this is prevented by the safety belt when it is in position. Since the pushbutton is intended for opening the lock and since the safety belt in position impairs the free mobility of the user, a long search for this pushbutton proves to be irritating. This circumstance assumes an even greater importance in the case of accidents or other danger.

It is now the object of the invention to provide a pushbutton lock of the type initially set forth, in which the pushbutton serving to release the locking of the lock is located at a point of the lock part, which is readily visible and can easily be reached.

According to the invention, there is provided a pushbutton lock for a safety belt comprising, a first lock part having an insertion opening at one end, a second slide-in tongue part insertable into said opening in an axially extending plane of said first part, a transverse edge on said tongue part, a receiving housing in said first lock part having a web portion and a side wall on each side edge thereof, a fixed stop on said receiving housing engageable by the transverse edge to lock said second part relative to said first part; each side wall having a slot angled with respect to said axial plane, so as to be spaced further from said stop, with respect to said plane, at the end of the slot more remote from said one end than at the end nearer said one end and a pushbutton axially slidable in said receiving housing and comprising a a cross-bar, two side walls spaced apart by said cross-bar, a manually actuable portion at said one end, and elements engaging in said slots whereby, when the manually actuable portion of the pushbutton is pressed in an axial direction towards the interior of the receiving housing, said elements will guide said pushbutton from a first position, in which the cross-bar locks the tongue part, so that the transverse edge engages said stop to lock the tongue part relative to the first part, to a second position in which the transverse edge can disengage the stop to release the tongue part.

The pushbutton lock according to the invention has all the advantages of the lock known from German Pat. No. 2,339,910. Furthermore, the pushbutton located on the end face of the lock part is readily visible and can easily be reached at any time and can thus also be actuated simply. This advantage will manifest itself particularly in emergencies, in case of accidents or the like, when a rapid release of the locking of the belt lock is very important.

Particularly reliable functioning of the pushbutton is achieved when the two side walls of the pushbutton each have close to the insertion opening, a longitudinal slot which extends approximately in the central plane of the lock part and into each of which protrude the ends of an axis which is approximately parallel to the transverse bolt and serves as a tilting axis for the pushbutton. This prevents jamming of the pushbutton during the displacement motion.

Moreover, it is within the scope of the invention to provide the pushbutton with a return spring which acts as an extension spring against the direction of actuating the pushbutton and one end of which is fixed in an incision in the side of the receiver housing, carrying the insertion opening, and the other end of which is fixed to the transversely extending U-bridge of the pushbutton. The return spring always holds the pushbutton in its starting position of readiness.

Figure 2:
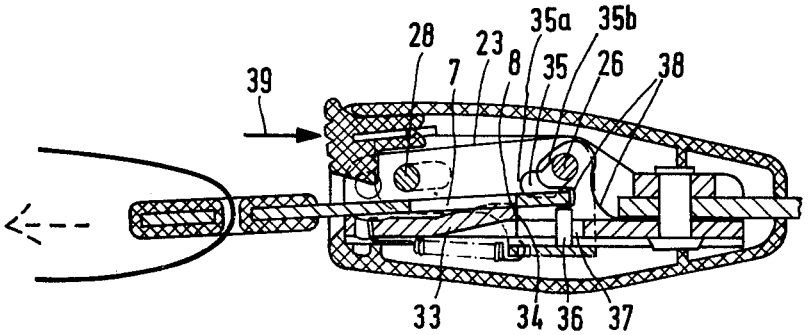

In order that the details and advantages of the invention as well as the mode of operation of the pushbutton lock according to the invention will be better understood, the following description of a preferred embodiment of the invention is given, reference being made to the accompanying drawings in which:

FIG. 1 is a longitudinal section through this embodiment of lock in the locking position; and FIG. 2 is a longitudinal section through the same lock in the release position.

The pushbutton lock shown in the drawing has, on the one hand, a lock part 1 which is fastened to one belt end 2 and, on the other hand, a slide-in tongue part 3 which can be fixed in this lock part 1 and with which the other belt end 4 engages. The lock part 1 can, of course, be fastened to a member which is rigidly or semi-rigidly fixed to the body of the vehicle, rather than to a belt part 2.

In a manner which is in itself known, the slide-in tongue part 3 consists of a slide-in tongue 5 which has a recess or slot 7 close to its front end 6, as a result of which a transverse edge 8 is formed. The front end 6 of the slide-in tongue 5 can be inserted into the interior of the lock part 1 through an insertion opening 10 provided transversely on the front end 9 of the lock part 1. The rear part 11, projecting from the insertion opening 10, of the slide-in tongue 5 is provided with a coating 12, in general sprayed on, of plastic or the like. In this part, a transverse slot 13 is formed, through which the belt end 4 passes for fixing.

The lock part 1 comprises an outer housing 14 which is preferably moulded from plastic. For assembly and moulding reasons, it is advantageous to design the outer housing 14 in two parts separated at the central plane passing through the insertion opening in the longitudinal direction. On the rear end 15 of the outer housing 14, opposite to the front end 9, the belt end 2 is introduced into the interior of the lock part 1 and is fixed to a receiving housing 16, for example by means of a rivet 17.

The receiving housing 16 comprises a transverse web 18 to which side walls 19, extending approximately perpendicular to the plane of the slide-in tongue 5, are attached on each side. Close to the rear end 15, these are adjoined by a transverse bridge 20 which fixes the belt end 2 and through which the rivet 17 passes. A pushbutton 21 of generally U-shaped cross-section is hinged from the outside to the side wall 19 of the receiver housing 16. The pushbutton 21 has a first web 22 and two side walls 23 extending on the outside parallel to the side walls 19. Close to the front end 9 of the lock part 1, the pushbutton 21 is provided with a second web 24 which is located on the side opposite to the web 22. This second web 24 is provided with a facing 25 for actuating the pushbutton, which facing is in general conspicuously coloured—preferably in red. The facing 25 of the pushbutton 21 can be provided with grooves on the surface. The pushbutton 21 is actuated in the direction of the arrow (FIG. 2), that is to say substantially axially to the lock part 1.

In the zone adjoining the first web 22, the two side walls 23 of the pushbutton 21 have mutually aligned bores into which a transverse cross-bar 26 is inserted which connects the two side walls 23 and is located approximately in the central plane of the lock part 1, perpendicular to the direction of insertion. Close to the insertion opening 10, each side wall 23 of the pushbutton 21 has a longitudinal slot 27 which extends substantially in the central plane of the lock part 1 and into which protrude the ends of a shaft 28 which is approximately parallel to the transverse bolt 26 and serves as a tilting axis for the pushbutton 21.

The pushbutton 21 is loaded by a resetting spring 29 which acts against the direction of actuating the pushbutton, marked by the arrow 39 in FIG. 2, and one end 30 of which is fixed in an incision 31 made in the end face 9 of the receiving housing 16 and the other end 32 of which is fixed to the transversely extending first web 22 of the pushbutton 21.

Locking of the slide-in tongue 5 within the lock part 1 is possible because the web 18 of the receiver housing 16 is provided with a stop 33 which corresponds to the shape of the recess 7 in the slide-in tongue 5. The stop 33 can advantageously be produced by bending the web 18 at an appropriate point. The projecting edge 34 of the stop 33 interacts with the transverse edge 8 of the slide-in tongue 5.

The transverse bolt 26 which passes through the side wall 19 of the receiving housing 16 on each of the two sides in a slot 35, serves to lock the slide-in tongue in the position shown in FIG. 1, in which the transverse edge 8 of the slide-in tongue 5 engages with the fixed stop 33. The two slots 35 are mutually aligned and approximately extend obliquely in the direction of insertion of the slide-in tongue 5, starting approximately from the central plane of the lock part 1 towards the side remote from the slot 33. These slots 35 thus form a type of slotted link guide for the transverse bolt 26. Since the latter is rigidly joined to the side walls 23 of the pushbutton 21, it is moved, when the pushbutton 21 is pressed into the interior of the lock part 1, from the locking position (FIG. 1) close to the slide-in tongue 5 into the release position (FIG. 2) as a result of which the locking is released. Since the cross-bar 26 fixed to the pushbutton 21 is guided in the obliquely extending slots 35 of the side walls 19, the pushbutton 21 is forced to execute a tilting motion.

In order to achieve reliable fixing of the cross-bar 26 in the locking position, the slot 35 is sub-divided into two sections **35*a* and 35*b*. Since it extends approximately parallel to the slide-in tongue 5, the section 35*a* which is first in the direction of insertion holds the transverse bolt 26 close to the slide-in tongue 5 even in the case of slight axial displacements of the pushbutton 21. The slide-in tongue is released only when the pushbutton 21 is moved for such a distance that the cross-bar 26 reaches the second section 35*b***.

When the cross-bar 26 has then left its locking position, the slide-in tongue 5 can detach itself from the stop 33. To accelerate this release step or to ensure that it takes place, the pushbutton 21 is provided on the inside of the U-bridge 22 with a press-away pin 36 which acts on the front end 6 of the slide-in tongue 5. As a result of the tilting motion of the pushbutton 21, the transverse edge 8 is disengaged from the projecting edge 34 of the stop 33 by means of the press-away pin 36. The slide-in tongue 5 is thus released from the locking position, as shown in FIG. 2. In this way, it is ensured that, when the pushbutton 21 is actuated, not only the locking for the slide-in tongue 5 is released but simultaneously the slide-in tongue is also positively disengaged from the fixed stop 33 on the receiving housing 16, without it being necessary for the slide-in tongue to assume a special oblique position relative to the transverse web 18 of the receiving housing 16. The press-away pin 36 can be formed by a separate round pin—as shown in the drawing—or by a bent-off part of the first web 22 of the pushbutton 21. The transverse web 18 of the receiving housing 16 must have a recess 37 close to the press-away pin 36, so that the press-away pin 36 can pass through the recess and make contact with the front end 6 of the slide-in tongue 5.

To ensure reliable release of the connection between the two belt parts even in the case where the belt is not under tension, it is possible to provide, in the receiving housing 16 in the region of the cross-bar 26, an ejector spring 38 which is held, for example, by the rivet 17 and fixed between the coverplate 18 and the transverse bridge 20. Advantageously, the ejector spring is a leaf spring which, on insertion of the slide-in tongue, is tensioned by the latter and locked in the tensioned position by the cross-bar 26 and is also released by the latter on unlocking, so that it ejects the slide-in tongue from the interior of the lock part.

We claim:

1. A push button lock for a safety belt comprising, in combination:

(a) A first lock part having an insertion opening at one end;

(b) A second slide-in tongue part insertable into said opening in an axially extending plane of said first part;

(c) A transverse edge on said tongue part;

(d) A receiving housing in said first lock part;

(e) A fixed stop on said receiving housing engageable by the said transverse edge to lock said second part relative to said first part;

(f) A web portion on said receiving housing;

(g) A side wall on each side edge of said web portion;

(h) A slot in each side wall, angled with respect to said axial plane, so as to be spaced further from said stop, with respect to said plane, at the end of the slot more remote from said one end than at the end nearer said one end; and (i) A push button axially slideable in said receiving housing and comprising a cross-bar, two side walls spaced apart by said cross-bar, a manually actuable portion at said one end, and elements engaging in said slots whereby, when the manually actuable portion of the push button is pressed in an axial direction towards the interior of the receiving housing, said elements will guide said push button, from a first position in which the cross-bar locks the tongue part, so that the transverse edge engages said stop effective to lock the tongue part relative to the first part to a second position in which the transverse edge can disengage the stop to release the tongue part.

2. A push button lock as claimed in claim 1, wherein said elements engaging in said slots form part of said cross-bar.

3. A push button lock as claimed in claim 1 and further comprising resilient means urging said push button towards its first position.

4. A push button lock as claimed in claim 1, wherein said receiving housing further comprises a first web portion between said side wall and located within said receiving housing and a second web portion extending between the said side walls and carrying said manually actuable portion.

5. A push button lock as claimed in claim 1 and further comprising a first web portion extending between said side walls of the push button within said receiving housing, a spring extending from said first web portion to said receiving housing effective to urge said push button towards its first position.

6. A push button lock as claimed in claim 1 wherein the two side walls of said push button each further comprise means defining a longitudinal slot extending approximately in said axial plane and a shaft mounted on the side walls of the receiving housing and passing through said slot to act as a tilting axis for the push button.

7. A push button lock as claimed in claim 1, wherein the slot is subdivided into a first section extending generally parallel to the axial plane at the end of the slot near said first end and a second slot portion angled with respect to said first slot portion.

8. A push button lock as claimed in claim 1 wherein said push button further comprises a first bridge extending between the side walls of said push button and a press away pin mounted on said web effective to engage the tongue and positively move the tongue whereby the transverse edge is disengaged from the stop as the push button is moved from the first to second position.

9. A push button lock as claimed in claim 1 and further comprising a release spring mounted in said receiving housing effective to urge said tongue part out of the housing when the transverse edge is disengaged from the stop.

* * * * *